US005921321A

United States Patent [19]

Sepich

[11] Patent Number: 5,921,321

[45] Date of Patent: Jul. 13, 1999

[54] HYDROCARBON VENT HOOD

[76] Inventor: John Edward Sepich, 680 Walnut St., Moorpark, Calif. 93021

[21] Appl. No.: 08/938,865

[22] Filed: Sep. 26, 1997

Related U.S. Application Data

[60] Provisional application No. 60/033,064, Dec. 13, 1996.

[51] Int. Cl.[6] ..... E21B 33/02; E21B 33/03

[52] U.S. Cl. ..... 166/379; 166/75.13; 166/79.1; 166/85.1; 52/20

[58] Field of Search ..... 166/379, 75.13, 166/75.14, 79.1, 85.1, 85.5; 52/20; 404/25, 26; 137/363, 371

[56] References Cited

U.S. PATENT DOCUMENTS

| | | | |
|---|---|---|---|
| 695,278 | 3/1902 | Cochran | 166/79.1 X |
| 890,573 | 6/1908 | Phelan | 52/20 X |
| 1,045,037 | 11/1912 | Kimball . | |
| 1,395,807 | 11/1921 | Forni | 137/371 X |
| 1,642,245 | 9/1927 | Judy . | |
| 1,830,061 | 11/1931 | Howe | 166/79.1 |
| 1,857,788 | 5/1932 | Murphy | 166/79.1 X |
| 2,026,844 | 1/1936 | Minahan | 166/79.1 |
| 2,635,696 | 4/1953 | Asketh . | |
| 3,247,672 | 4/1966 | Johnson . | |
| 3,380,519 | 4/1968 | Fowler | 166/379 |
| 4,747,453 | 5/1988 | Howard, Sr. | 166/379 |
| 4,971,149 | 11/1990 | Roberts | 166/92.1 |
| 5,010,957 | 4/1991 | Kenner | 166/379 |
| 5,299,637 | 4/1994 | Skonvall | 166/75.1 |
| 5,484,020 | 1/1996 | Cowan | 166/295 |
| 5,503,227 | 4/1996 | Saponja et al. | 166/277 |
| 5,701,953 | 12/1997 | Stecker et al. | 166/379 X |

FOREIGN PATENT DOCUMENTS 2035426 6/1980 United Kingdom .

OTHER PUBLICATIONS

California Division of Oil, Gas and Geothermal Resources letter of Dec. 14, 1995.

California Division of Oil, Gas and Geothermal Resources letter of May 7, 1996.

California Division of Oil, Gas and Geothermal Resources Regulations dated May 17, 1995.

*Primary Examiner*—George Suchfield
*Attorney, Agent, or Firm*—Ralph D. Chabot

[57] ABSTRACT

An improved vent hood for abandoned oil and gas wells which is made of concrete and reinforced with linear and coiled rebar to withstand substantial overburden. The invention includes a layer disposed about its interior surface which is impermeable to methane gas. The invention can be fabricated in a single-section conical embodiment or a two-section conical or cylindrical embodiment. The two-section embodiment allows the base conical or cylindrical member to be positioned around the abandoned well casing and thereafter filled with gravel. A concrete lid having an aperture is thereafter placed upon the base section. A vent pipe is thereafter inserted into the aperture to permit gas collected within the vent hood to flow to surface.

20 Claims, 3 Drawing Sheets

Fig. 6a
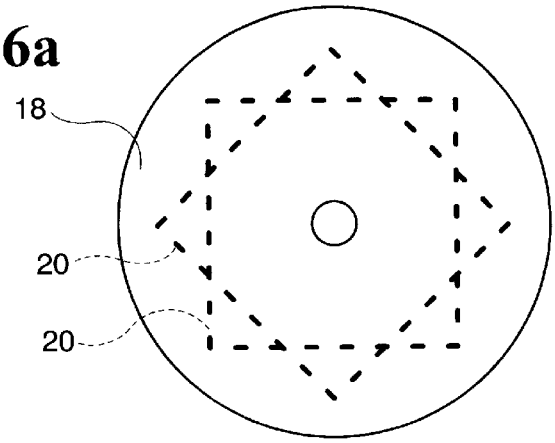
Fig. 6b
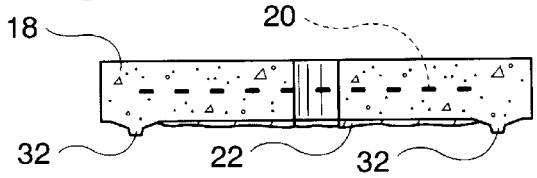
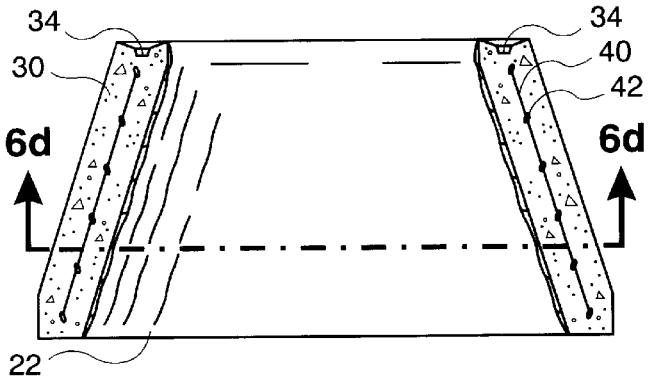
Fig. 6c
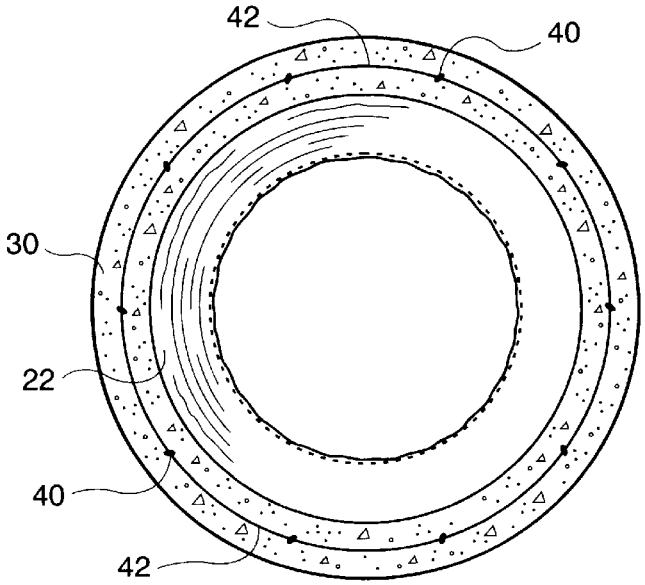
Fig. 6d

HYDROCARBON VENT HOOD

This application claims priority under 35 U.S.C. Section 119(e) to a provisional application filed Dec. 13, 1996 bearing Ser. No. 60/033,064.

TECHNICAL FIELD

This invention relates to abandoned natural gas or oil wells and specifically, to the venting of gas and hydrocarbon vapors from the soil adjacent abandoned wells.

BACKGROUND—DESCRIPTION OF PRIOR ART

Venting of abandoned oil/natural gas wells is sometimes required by regulatory agencies; or may be desired by well owners or property developers. The purpose of venting an abandoned oil or gas well is to allow gases and hydrocarbon vapors that may come up through or around the abandoned well casing(s) to vent to the atmosphere in a controlled manner.

Casings, as described above, may be either: (1) production casings which are strings of pipe through which gas and/or oil was delivered to the surface from the depth at which it originates in the earth; or, (2) conductor casings which are larger diameter, shorter length casing strings generally used around the production casing to prevent earth caving prior to and during installation of the production casing string.

One agency which presently sets forth requirements for vent hoods is the State of California (USA), Department of Conservation, Division of Oil and Gas and Geothermal Resources (DOGGR). Their requirements specify minimum dimensions for a vent hood, but do not identify materials of construction. The required minimum dimensions are also intended to provide a volume estimate for the interior of the vent cone.

Various materials have been used for vent hoods in the prior art. Some of the materials and their method of installation include the following:

A. Brick Cone. The brick work would begin with a ring of bricks laid to the appropriate diameter on an earth shoulder around an abandoned well. Construction of the brick work would progress with additional courses of brick laid in ever smaller diameters until a cone would be formed around the well. During its construction, the interior of the cone would be filled with rock. A vertical pipe riser would be installed coming out of the top of the cone and run to an above-surface vent riser. Disadvantages of this method include that it is labor intensive; the quality of the field work is variable; and bricks are not considered a perfect methane gas barrier because of the high potential for the gas to escape through joints or cracked masonry units.

B. Fiberglass Cone. Normal construction would include placing a mound of rock over the abandoned well and then the fiberglass cone on top of the rock mound. Fiberglass is a good gas/vapor barrier. However, there are disadvantages associated with using fiberglass. The shape of the cone may not match the shape of the mound; and cracking of the cone can occur from soil overburden, particularly where the cone is not completely supported by the rock mound. Cracking may also occur at the top of the cone from distress where the vent pipe extends out of the cone, because of the nature of the fiberglass material. Additionally, when a cone is not filled completely with rock, the surrounding soil can eventually migrate underneath the hood into spaces not filled with rock. This migration will then leave soil voids outside the vent cone. These soil voids can eventually lead to undesired settlement observed at the surface. Settlement can cause structural damage, particularly when the abandoned well is in close proximity to buildings or if utility or other conduits are located within the settlement zone.

C. HDPE (High Density PolyEthylene) tank. A full tank made of heavy HDPE would be cut in half. A half tank would be placed over the well and filled with rock. HDPE is an acceptable gas/vapor barrier. Heavy walled HDPE is somewhat flexible and less likely to crack than fiberglass. Distress can still occur where the vent pipe attaches to the HDPE body. When a cone is not completely full of rock the surrounding soil can eventually migrate underneath the hood into spaces not filled with rock with the same results as described above under fiberglass cones.

D. HDPE plastic sheeting. HDPE plastic sheeting is very flexible and would not be susceptible to crack failure. The vertical vent pipe would be "booted" to the top portion of the sheeting and would not be susceptible to cracking failure. Disadvantages are that the field HDPE membrane installation involves special equipment for thermal welding, is labor intensive and must be carefully inspected to insure against leaks in seams. The material must also be carefully protected against puncture from the rock fill, and also from the earth backfill. In addition the flexible HDPE membrane does not hold its shape. The normal construction practice has been to carefully line an excavation with the membrane, and then backfill with rock; and finally weld on a lid section of membrane. Here, proper function is dependant upon the accuracy of the excavation. Flexible membrane liners have no structural strength and could tear or puncture. The excavation may also be larger than necessary. If this occurs, more membrane and rock material is required and the cost of installation increases. Also the length of time required to install a flexible membrane can be a disadvantage for a project which requires a fast schedule.

One disadvantage common to all of the prior art described is that all require special on-site inspection during the installation process to observe for cracks and other defects which would affect vent hood integrity.

SUMMARY OF THE INVENTION

My invention, a steel reinforced concrete vent hood, is an improvement over the prior art, for the reasons described below.

The invention provides a stable hood location around an abandoned well. It can be fabricated off-site and transported to the desired location. The vent hood is comprised of reinforced concrete utilizing coiled rebar disposed circumferentially within the wall of the cone or cylinder, and a plurality of linear rebar evenly spaced and positioned within the wall. Each linear rebar is fastened to the coiled rebar to maintain spacing before the concrete is poured. Fastening can include either tie wire or tack-weld. Sizing and placement of both types of rebar may be subject to structural calculations for the specific project loading condition. Disposed on the interior wall (conical or cylindrical) is a layer or lining which is impermeable to methane gas. The layer is capable of spanning cracks in the concrete which are present or which may occur at a later time.

In its standard six-inch thick wall, reinforced concrete configuration, my invention can be buried up to 50 feet deep; and deeper with modifications to the wall thickness and/or reinforcing steel placement as required.

The conical concrete section provides considerable resistance to overburden loads because of the great strength of reinforced concrete in compression. The conical shape is ideal for heavy loading.

The novel vent hood also minimizes stress damage from occurring at the vent pipe connection due to the combination of the reinforced concrete cone and lid, and the various vent pipe connection means described later.

The novel vent hood can be comprised of one or two sections. The one-section vent hood is in the shape of a hollow cone. Preferably, two sections are used. The two sections comprise a lid and either a cylindrical base or conical base. The vent hood configuration utilizing a lid has a sufficient opening at the top of the base section to allow rock or gravel to be poured into the base, permitting the interior cavity to be filled. Filling the interior is an improvement over one piece devices which are placed over a rock pile, possibly without a close fit to the shape of the pile. Without a close fit, even if the vent cone does not crack due to overburden settlement at the void areas, the surrounding soil can still eventually migrate underneath the hood into spaces not filled with rock. This migration is undesirable for the reasons mentioned earlier.

Quality control can be maintained during fabrication of the vent hood and inspection of the fabricated vent hood can occur prior to installation. Special on-site inspection of the vent hood fabrication is therefore unnecessary. This minimizes field labor and installation time resulting in a lower labor cost over the prior art installations. The installation process is as follows. The base of any of the three configurations (cylinder section, conical section, or single section cone) is positioned over an abandoned well. Normally the well has been exposed below grade by an excavation which provides some flat or deck area at the base of the excavation around the well. The excavation may be five to twenty feet deep, or even deeper below the adjacent grade (ground surface elevation). Where rock is required to fill the interior, either the two section lid and conical base or lid and cylindrical base is preferred since rock can be added to the base interior before a reinforced concrete lid is placed on top of the base section. Specifically, rock can be poured directly into either cylindrical or conical base section from the top opening or orifice.

For installations using either the conical or cylindrical base sections, the second (lid) section mates to the base section. A sealant such as an asphaltic neoprene, or other material with low gas permeability is applied to the mating surface of the base and lid sections. Then the second section (lid) is lowered into place. The low gas permeability material must be applied to insure continuity of the conical section impermeable layer or lining with the lid underside impermeable layer or lining. This will prevent gas leakage and more specifically, methane gas leakage at the mating joint.

The lid of the two section vent hood, or the top of the one piece cone vent hood, contains an orifice into which a vent pipe may be installed to communicate any gas captured within the hollow conical or cylindrical vent hood, to a vent stack located above the ground. The vent pipe utilizes conventional connection means such as a rubber ring made to join piping, or caulking directly into the lid or cone, or a threaded or slip fitting cast into the lid or cone.

Where a number of vent installations will occur, the invention also has the advantage in that a number of vent hoods can be fabricated and inspected as a group prior to installation.

Although adding rock to the interior is not required, it is recommended. Preferably, specially sized pea rock is used. Pea rock may be approximately ¼ inch in overall dimension. This small size minimizes the chance of damage to the impermeable membrane liner which might be a problem with larger rock. Also the use of pea rock provides good permeability for gas movement while still acting to keep soil migration out of the cone.

The use of a vent hood without rock added to the interior could be used in jurisdictions where there is no government agency requirement for rock, and where there is no danger of soil migration into the vent hood as described above. Soil migration might not be a problem, for instance, in native rock with specially designed backfill and installation.

In summation, my invention is an improvement over prior art configurations because a structurally reinforced concrete vent hood having an impermeable gas barrier is provided where inspection can occur off-site, and thereafter transported and installed on-location quickly and efficiently.

DESCRIPTION OF THE DRAWINGS

FIG. 6*a* is a cross-sectional view of FIG. 2*a* along line X—X.

FIG. 6*b* is a side view of the lid section.

FIG. 6*c* is a side view of the cone section .

FIG. 6*d* is a cross-section of the cone section of FIG. 6*c* taken along line 6—6.

DETAILED DESCRIPTION OF THE PREFERRED EMBODIMENT

Figure 1:
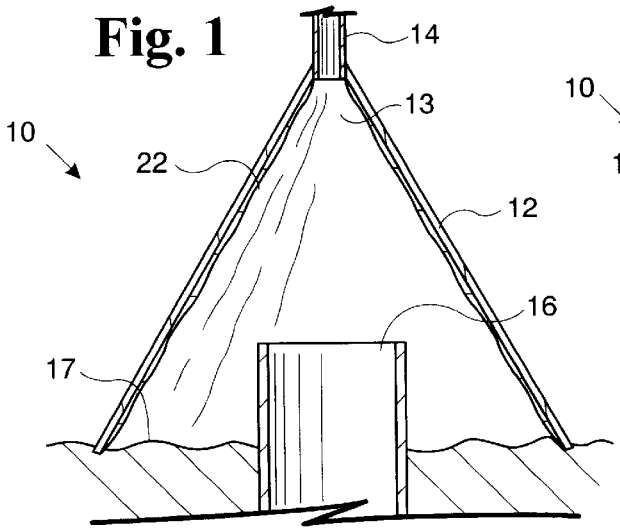
FIG. 1 illustrates the invention in position over an abandoned well casing.

FIG. 1 illustrates the application of the vent hood 10. A single section cone 12 is shown having a vent pipe 14 extending from the top orifice 13 to above ground level.

An abandoned oil well casing 16 is exposed with the surrounding soil 17 excavated to a desired level below the top of casing 16. Preferably, casing 16 is exposed at least 12 inches. The base diameter of vent hood 10 at its bottom end is required to be larger than the diameter of the hole drilled to install casing 16.

Figure 2A:
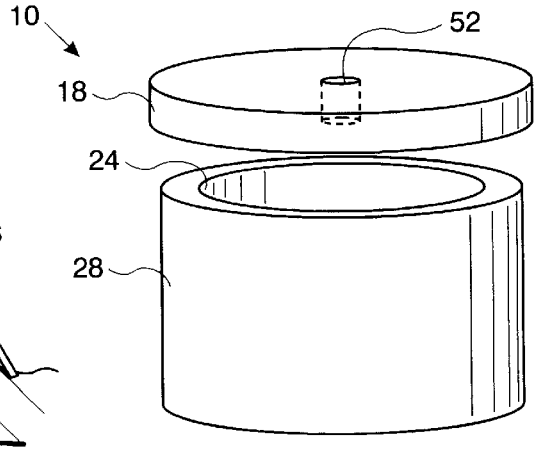
FIG. 2*a* illustrates the invention in a two section cylinder and lid configuration.
Figure 2B:
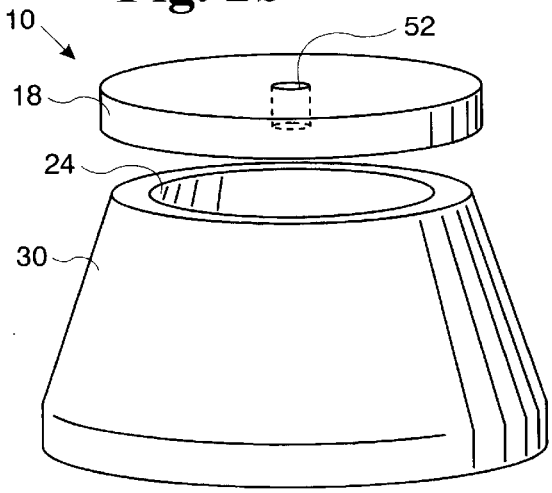
FIG. 2*b* illustrates a two-section conical and lid alternative embodiment.
Figure 2C:
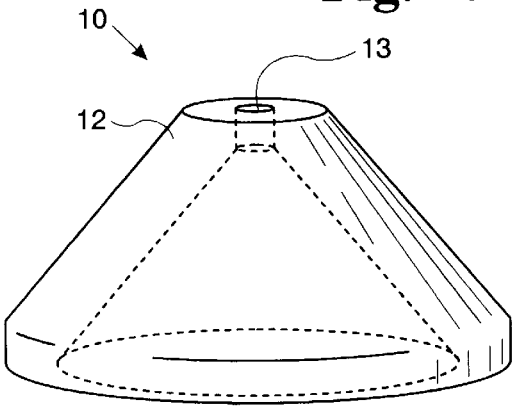
FIG. 2*c* illustrates a single section hollow cone alternative embodiment.

FIGS. 2*a,* 2*b* and 2*c* show the embodiments of the present invention. Preferably, the two section configurations of FIGS. 2*a* (lid 18 and cylindrical base 28) and 2*b* (lid 18 and conical base 30) are used since gravel may be inserted into the top opening or orifice 24 of the base section after it is positioned properly about the casing. A tight gravel pack (not shown) within the cavity of the base section will provide additional compressive strength against soil overburden once vent hood 10 is buried. Most preferably, the two piece conical configuration of FIG. 1*b* is desired.

During the vent hood fabrication process, a skeleton or cage of rebar is fabricated. As shown in FIGS. 6*a,* 6*b,* 6*c* and 6*d* this cage comprises a plurality of linear rebar 40. It is noted that the steel cage may also be fabricated for cylindrical base 28. The linear rebar 40 is preferably spaced 5 inches from one another. Coiled rebar 42, preferably of a thickness of #4 or heavier, is fastened to the linear rebar from the lower to upper end of the base section. As coiled wire 42 contacts a linear rebar 40, each is fastened to the other by an appropriate means such as tie-wire or a tack weld. Preferably, as coiled rebar 42 is fastened to linear rebar 40, the spacing is no greater than 5 inches from the coil above or below. Once the rebar cage is fabricated, concrete is poured about the rebar cage to form the base section. Linear rebar 40 is preferably evenly spaced within the concrete wall of the base section and about the cavity.

Lid 18 is formed in a similar manner. For structural integrity, a pair of linear rebar 20 are formed into squares. Squares 20 are then positioned above one another and orientated so that one is offset to the other by 45 degrees. Concrete is then poured about linear rebar 20 to form lid 18 which is shown in FIG. 6*a*.

Once the vent hood is fabricated, an impermeable gas membrane 22 is disposed on the interior wall of the base section or single cone section. There are three primary methods for applying the impermeable gas membrane 22 onto the interior wall of base sections 28, 30 or one-piece cone section 12. As used in this specification, membrane 22 can mean a spray-on layer, a surface coating, or sheeting material. The first method is the installation of HDPE (high density polyethylene) sheeting about the interior wall of the base section using a mastic tape with double-sided adhesion. The tape is first attached to the interior circumferential surface near both the top end and bottom end of either base section or single-section cone. Next, the sheeting is disposed on the interior wall circumference of the section, adhering to the mastic tape affixed to the section's interior wall. The second method utilizes a strip of HDPE or other plastic material which is partially embedded within the base section during its forming and extends out from the base section interior wall into the interior cavity. HDPE sheeting is then lined about the interior cavity and thermal welded to the strip protruding from the concrete surface. HDPE sheeting is typically within the range of 20–100 mils in thickness. Other sheeting which can be used alternatively to HDPE include PVC (polyvinyl chloride) and CPE (chlorinated polyethylene).

The third and most preferred method is to apply the impermeable gas membrane 22 by spray. Besides being faster to apply than HDPE sheeting, the spray-on application allows the membrane material to fill and seal hairline cracks in the concrete which may be present. It is preferred that a chloroprene modified asphalt be used as the spray-on material. Depending upon weather conditions, a catalyst may be added to the spray mix to accelerate the cure time of membrane 22. Other formulations of spray-on substances may also be used to obtain an impermeable methane gas membrane.

It is also recommended that the bottom face of the lid section have an impermeable gas membrane 22. Either of the methods described above can be used.

Figure 3:
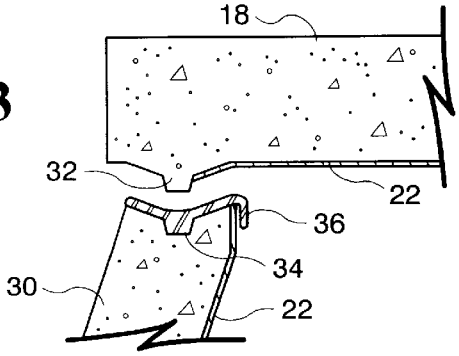
FIG. 3 shows the tongue and groove configuration of the lid and base sections respectively.

Although not required, it is preferred that a tongue 32 and groove 34 arrangement be utilized for properly fitting lid 18 onto base section 28 or 30. As illustrated in FIG. 3, proper installation of lid 18 to the base section would include the application of a sealant 36 about the tongue/groove interface which would also act to prevent methane gas from escaping through the lid/base section interface.

Figure 4A:
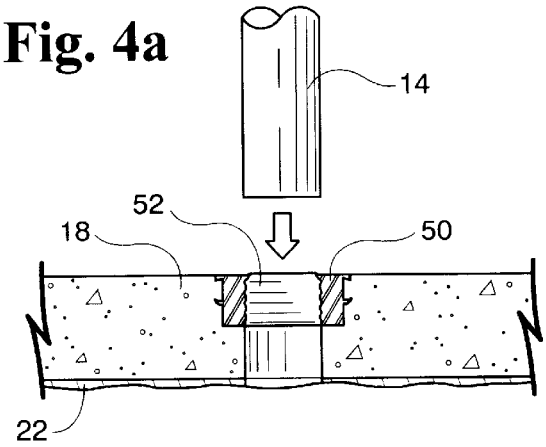
FIG. 4*a* illustrates connection of vent piping using a rubber ring.

Once vent hood 10 is in position, vent pipe 14 can be joined to vent hood 10 by a number of conventional means as best illustrated in FIGS. 4*a,* 4*b,* 4*c* and 4*d*.

FIG. 4*a* illustrates a rubber ring push joint embodiment. Rubber ring 50 is disposed about an aperture 52 in lid 18. Aperture 52 can be made either during the forming of lid 18 or cored after lid 18 is formed.

Figure 4B:
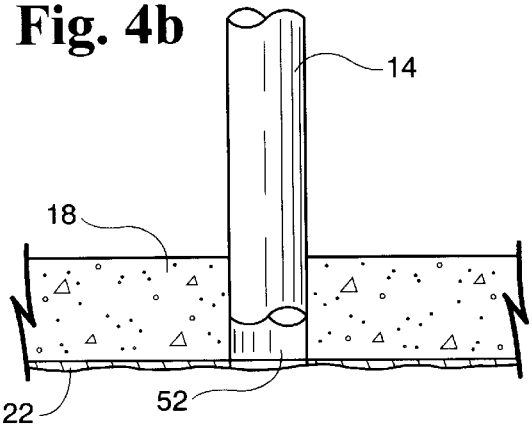
FIG. 4*b* illustrates a first alternative means of attaching a vent pipe to the invention.

FIG. 4*b* illustrates aperture 52 having a diameter slightly larger than the outside diameter of vent pipe 14. Insertion of vent pipe 14 into aperture 52 produces a snug fit interface. The interface is thereafter caulked or other type of sealant is used to secure in place.

Figure 4C:
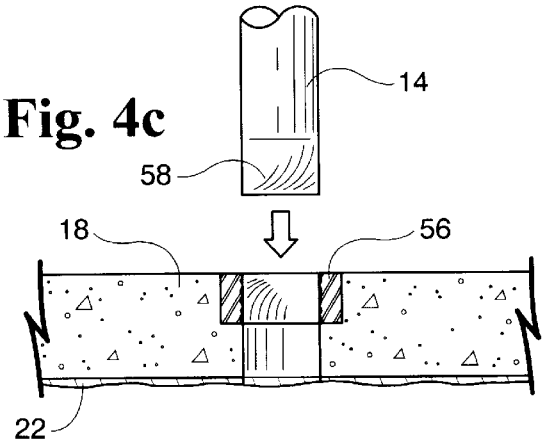
FIG. 4*c* illustrates a second alternative means of attaching a vent pipe to the invention.

FIG. 4*c* illustrates a threaded female fitting 56 cast into aperture 52 of lid 18. Vent pipe 14, in this configuration, has a threaded end portion 58 for threadably engaging female fitting 56.

Figure 4D:
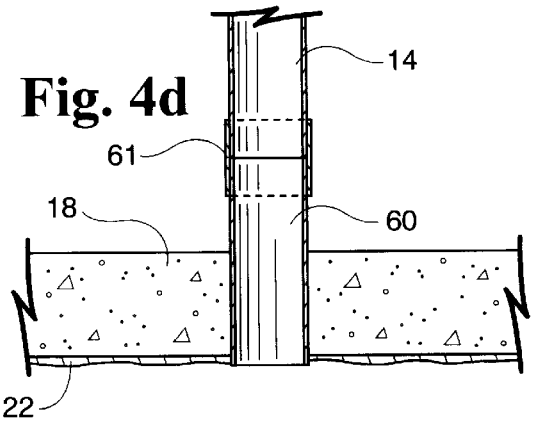
FIG. 4*d* illustrates a third alternative means of attaching a vent pipe to the invention.

FIG. 4*d* illustrates a pipe spool 60 which is cast into aperture 52 of lid 18. Pipe spool 60 is thereafter attached to vent pipe 14 by coupling 61 in any conventional manner such as slip fitting, thread engagement, etc.

Figure 5A:
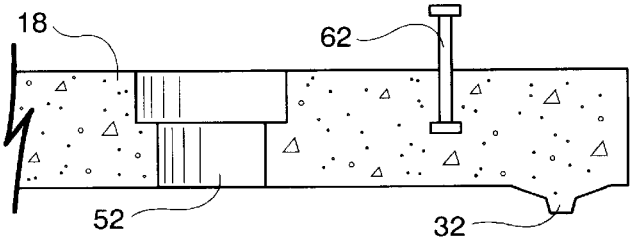
FIG. 5*a* is a partial cross-sectional side view of the lid section utilizing a first embodiment lifting pin.
Figure 5B:
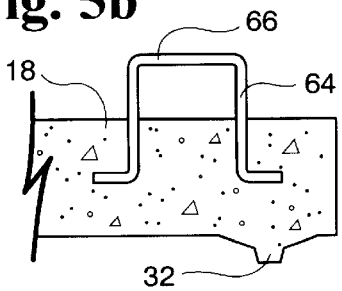
FIG. 5*b* is a partial cross-sectional side view of the lid section utilizing a second embodiment lifting pin.
Figure 5C:
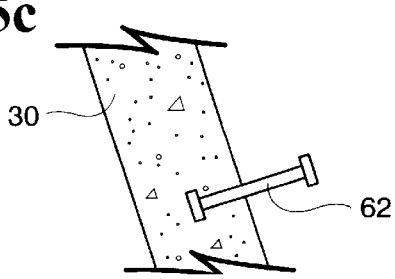
FIG. 5*c* is a partial cross-sectional side view of the cone section utilizing a first embodiment lifting pin.
Figure 5D:
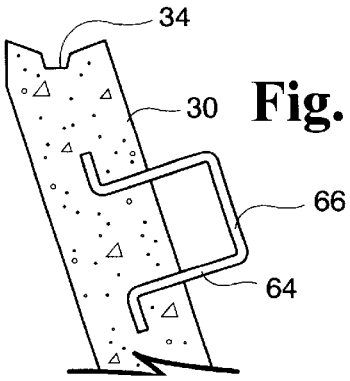
FIG. 5*d* is a partial cross-sectional side view of the cone section utilizing a second embodiment lifting pin.

Because of the preferred material of construction, my invention is relatively heavy. To facilitate an efficient means of transport and positioning, my invention incorporates the use of a lifting means. Two embodiments of a lifting means are illustrated in FIGS. 5*a,* 5*b,* 5*c* and 5*d*. Lifting pin 62 is defined as having one end embedded in the concrete wall and having a stem with a headed end extending away from the exterior wall surface. Lifting eye 64 is defined as having both ends embedded in the concrete wall with a center portion extending away from the exterior wall surface to form a loop 66. Pin 62 or eye 64 is preferably made of a rigid material and most preferably, steel or iron. A cable (not shown) can be temporarily secured to a lifting means on any section of vent hood 10 and lifted to a desired location by a winch or other suitable lifting device.

Other features and advantages of the invention will become apparent to those skilled in the art upon review of the following detailed description and claims.

I claim:

1. A vent hood for abandoned oil or gas wells comprising:

a concrete, open-ended conical-shaped hollow body having a predetermined wall thickness, said body having an exterior wall surface and an interior wall surface;

a cage disposed within said concrete wall to provide increased structural strength where said cage comprises:

(A) a plurality of linear rebar;

(B) a coiled rebar fastened to said plurality of linear rebar; and a layer disposed upon said interior wall surface which is impermeable to methane gas.

2. The vent hood of claim 1 further comprising a means to attach a vent pipe to said hollow body.

3. The vent hood of claim 1 further comprising a means to lift said body.

4. The vent hood of claim 1 wherein said impermeable layer is a chloroprene modified asphalt.

5. The vent hood of claim 1 wherein said impermeable layer is high density polyethylene sheeting.

6. The vent hood of claim 3 wherein said lifting means comprises a lifting pin, said lifting pin having one end embedded within said body wall and a stem with a headed second end extending away from said exterior wall surface.

7. The vent hood of claim 3 wherein said lifting means comprises a lifting eye, said lifting eye having two ends and a center section, said ends embedded within said body wall, and said center section extending away from said exterior wall surface to form a loop.

8. A vent hood for abandoned oil or gas wells comprising:

a first section and a second section, said first section comprising a concrete, hollow body having a predetermined wall thickness and hollow space therebetween, said body having an exterior wall surface and an interior wall surface, said first section further having a bottom end and a top end, said bottom end having a first orifice and said top end having a second orifice;

a cage disposed within said concrete wall to provide increased structural strength where said cage comprises:

(A) a plurality of linear rebar;

(B) a coiled rebar fastened to said plurality of linear rebar;

said second section comprising a concrete lid having an annular body of a predetermined wall thickness, said lid having rebar disposed within said concrete lid, said lid having a radial extent substantially equal to the top of said first section, said lid having a top face, a bottom face; and an aperture between said faces.

9. The vent hood of claim 8 further comprising a layer impermeable to methane gas disposed upon said interior wall surface and said bottom face.

10. The vent hood of claim 8 wherein said impermeable gas layer is high density polyethylene sheeting.

11. The vent hood of claim 8 further comprising a lifting means.

12. The vent hood of claim 11 wherein said lifting means comprises at least one lifting pin attached to each of said sections, each said lifting pin having one end embedded within a respective section and a stem having a headed second end extending away from said section.

13. The vent hood of claim 11 wherein said lifting means comprises at least one lifting eye attached to each of said sections, each said lifting eye having two ends and a center portion connected to said ends, said ends embedded within said respective section, and said center portion extending away from said exterior wall surface to form a loop.

14. The vent hood of claim 8 wherein said first section has a conical configuration.

15. The vent hood of claim 8 wherein said first section has a cylindrical configuration.

16. The vent hood of claim 8 wherein said top end of said first section and said bottom face of said second section lid utilize a tongue and groove arrangement for properly disposing said lid upon said first section.

17. An improved method of venting gas from abandoned oil and gas wells, the improved method comprising:

providing a vent hood having a first section and a second section, said first section comprising a concrete, hollow body having a predetermined wall thickness and hollow space therebetween, said body having an exterior wall surface and an interior wall surface, said first section further having a base end and a top end, said base end having a first orifice and said top end having a second orifice; a cage disposed within said concrete wall which comprises: (A) a plurality of linear rebar, and (B) a coiled rebar fastened to said plurality of linear rebar; said second section comprising a concrete lid having an annular body of a predetermined wall thickness, said lid having steel rebar disposed within said concrete lid, said lid having a radial extent substantially equal to the top of said first section, said lid further having a bottom face, an impermeable coating to methane gas disposed upon said lid bottom face and said interior wall surface;

positioning said first section over the top of the abandoned well;

lowering said first section so that the abandoned well will be partially disposed within said first section cavity;

filling said first section hollow space with gravel by directing said gravel through said second orifice;

applying a methane gas impermeable sealant to said top end of said first section;

positioning said lid section over said top end of said first section;

placing said lid section upon said top end of said first section whereby said sealant forms an impermeable barrier at the lid section-first section interface; and attaching a vent pipe to said lid.

18. A vent hood for abandoned oil or gas wells comprising:

a conical section and a cover, said conical section comprising a concrete, hollow body having a predetermined wall thickness and hollow space therebetween, said body having an exterior wall surface and an interior wall surface, said conical section further having a base end and a top end, said base end having a first orifice and said top end having a second orifice;

a cage disposed within said concrete wall where said cage comprises:

(A) a plurality of linear rebar;

(B) a coiled rebar fastened to said plurality of linear rebar;

a layer disposed upon said interior wall surface which is impermeable to methane gas;

said cover comprising a concrete annular body of a predetermined wall thickness, said cover having steel rebar disposed within said annular body, said cover having a radial extent substantially equal to the top end of said conical section, said cover having a top face, a bottom face, an aperture between said faces and a layer impermeable to methane gas disposed upon said bottom face;

the top end of said conical section further defined by a circular concave depression within said concrete wall, said cover further having a circular lip extending away from said bottom face, said circular lip equal in radial extent as said depression, the depth of said depression being greater than the extent of said lip away from said bottom face.

19. The vent hood of claim 18 wherein said impermeable gas layer is a chloroprene modified asphalt.

20. The vent hood of claim 18 wherein said impermeable gas layer is high density polyethylene sheeting.

* * * * *

UNITED STATES PATENT AND TRADEMARK OFFICE

CERTIFICATE OF CORRECTION

PATENT NO. : 5,921,321
DATED : July 13, 1999
INVENTOR(S) : Sepich

It is certified that error appears in the above-identified patent and that said Letters Patent is hereby corrected as shown below:

Claim 10,
Replace "8" with -- 9 --.

Signed and Sealed this

Twelfth Day of February, 2002

*Attest:*

*Attesting Officer*

JAMES E. ROGAN
*Director of the United States Patent and Trademark Office*